US008806710B2

(12) United States Patent
Follows et al.

(10) Patent No.: US 8,806,710 B2
(45) Date of Patent: Aug. 19, 2014

(54) CLEANER HEAD

(75) Inventors: Thomas James Dunning Follows, Malmesbury (GB); Stephen Benjamin Courtney, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 259 days.

(21) Appl. No.: 12/791,659

(22) Filed: Jun. 1, 2010

(65) Prior Publication Data

US 2010/0306957 A1 Dec. 9, 2010

(30) Foreign Application Priority Data

Jun. 9, 2009 (GB) ..... 0909896.3

(51) Int. Cl.

| | |
|---|---|
| ***A47L 5/10*** | (2006.01) |
| ***A47L 5/26*** | (2006.01) |
| ***A46B 13/00*** | (2006.01) |
| ***A47L 9/04*** | (2006.01) |
| ***A46B 13/02*** | (2006.01) |

(52) U.S. Cl.

CPC ..... *A47L 9/0477* (2013.01); *A46B 13/006* (2013.01); *A46B 13/02* (2013.01); *A46B 2200/3033* (2013.01)

USPC ..... 15/383; 15/1.51; 15/141.2; 15/182; 15/207.2

(58) Field of Classification Search

USPC ..... 15/1.51, 141.2, 179–183, 198, 200, 15/207.2, 383, 398

See application file for complete search history.

(56) References Cited

U.S. PATENT DOCUMENTS

| | | | | | |
|---|---|---|---|---|---|
| 2,281,863 | A | | 5/1942 | Smellie | |
| 2,426,315 | A | | 8/1947 | Marick | |
| 2,459,007 | A | * | 1/1949 | Taylor | 15/383 |
| 2,578,549 | A | * | 12/1951 | Hooban | 15/344 |
| 2,659,921 | A | | 11/1953 | Osborn | |
| 3,186,019 | A | | 6/1965 | Hattori | |
| 3,614,801 | A | * | 10/1971 | Peabody | 15/179 |
| 3,771,189 | A | | 11/1973 | Horton et al. | |
| 3,908,223 | A | | 9/1975 | Brooks et al. | |

(Continued)

FOREIGN PATENT DOCUMENTS

| | | |
|---|---|---|
| CN | 101090660 | 12/2007 |
| DE | 32 05 199 | 8/1983 |

(Continued)

OTHER PUBLICATIONS

Information on Surface Resistivity; Plastics International.com found on internet wayback machine at: http://web.archive.org/web/20090502001116/http://plasticsintl.com/esd.htm dated Mar. 31, 2009.*

(Continued)

*Primary Examiner* — Brian Glessner
*Assistant Examiner* — Brian D Mattei
(74) *Attorney, Agent, or Firm* — Morrison & Foerster LLP

(57) ABSTRACT

A cleaner head for a surface treating appliance includes a housing and a rotatable brush bar located within the housing. The brush bar includes a first plurality of bristles and a second plurality of bristles which protrude radially outwardly beyond the first plurality of bristles. The second plurality of bristles has a surface resistivity in the range from $1\times10^{-5}$ to $1\times10^{12}$ Ω/sq so that static electricity residing on a floor surface to be cleaned is discharged upon contact with the conductive bristles.

32 Claims, 7 Drawing Sheets

(56) References Cited

U.S. PATENT DOCUMENTS

| | | | | |
|---|---|---|---|---|
| 4,186,030 | A | 1/1980 | Armstrong | |
| 4,197,610 | A | 4/1980 | Schneider | |
| 4,435,073 | A | 3/1984 | Miller | |
| 4,706,320 | A * | 11/1987 | Swift | 15/1.51 |
| 4,835,807 | A | 6/1989 | Swift | |
| 5,150,499 | A | 9/1992 | Berfield | |
| 5,187,526 | A | 2/1993 | Zaretsky | |
| 5,339,143 | A | 8/1994 | Kunzmann | |
| 5,452,490 | A * | 9/1995 | Brundula et al. | 15/182 |
| 5,689,791 | A | 11/1997 | Swift | |
| 5,701,633 | A | 12/1997 | Jonischus | |
| 5,905,932 | A | 5/1999 | Morse et al. | |
| 5,916,660 | A | 6/1999 | Currie et al. | |
| 6,199,244 | B1 | 3/2001 | Hilgers et al. | |
| 6,267,660 | B1 * | 7/2001 | Jespersen | 451/550 |
| 6,539,575 | B1 | 4/2003 | Cohen | |
| 2005/0039282 | A1 | 2/2005 | Paterson et al. | |
| 2005/0153558 | A1 | 7/2005 | Koh et al. | |
| 2005/0246857 | A1 | 11/2005 | Omoto et al. | |
| 2008/0000043 | A1 | 1/2008 | Frederickson | |
| 2010/0306956 | A1 | 12/2010 | Follows et al. | |
| 2010/0306958 | A1 | 12/2010 | Follows et al. | |
| 2010/0306959 | A1 | 12/2010 | Follows et al. | |

FOREIGN PATENT DOCUMENTS

| | | |
|---|---|---|
| DE | 34 18 224 | 11/1984 |
| DE | 43 06 734 | 9/1994 |
| DE | 195 47 311 | 6/1997 |
| EP | 0 313 403 | 4/1989 |
| EP | 0 992 211 | 4/2000 |
| GB | 734360 | 7/1955 |
| GB | 1 360 309 | 7/1974 |
| GB | 2 090 124 | 7/1982 |
| GB | 2 135 869 | 9/1984 |
| GB | 2 150 422 | 7/1985 |
| GB | 2 425 715 | 11/2006 |
| JP | 51-163755 | 12/1976 |
| JP | 5-269059 | 10/1993 |
| JP | 5-317226 | 12/1993 |
| JP | 6-105771 | 4/1994 |
| JP | 7-322 | 1/1995 |
| JP | 7-8425 | 1/1995 |
| JP | 7-327885 | 12/1995 |
| JP | 11-216088 | 8/1999 |
| JP | 2000-60775 | 2/2000 |
| JP | 2000-217753 | 8/2000 |
| JP | 2002-136457 | 5/2002 |
| JP | 2003-52584 | 2/2003 |
| JP | 2003-339590 | 12/2003 |
| JP | 2004-267452 | 9/2004 |
| JP | 2005-66034 | 3/2005 |
| JP | 2005-168796 | 6/2005 |
| JP | 2005-230514 | 9/2005 |
| JP | 2007-313037 | 12/2007 |
| JP | 2009-11374 | 1/2009 |
| WO | WO-99/27834 | 6/1999 |
| WO | WO-2006/080383 | 8/2006 |
| WO | WO-2006/098965 | 9/2006 |
| WO | WO-2009/149722 | 12/2009 |

OTHER PUBLICATIONS

Material Properties of Polypropylene found at: http://www.goodfellow.com/E/Polypropylene.html.*

Material Properties of Nylon found at: http://www.goodfellowusa.com/A/Polyamide-Nylon-6,-6.html.*

International Search Report and Written Opinion mailed Sep. 6, 2010, directed to counterpart International Application No. PCT/GB2010/050851; 12 pages.

GB Search Report dated Sep. 28, 2009, directed to counterpart GB Application No. 0909896.3; 1 page.

Follows et al., U.S. Office Action mailed Jun. 13, 2012, directed to U.S. Appl. No. 12/791,640; 12 pages.

Follows et al., U.S. Office Action mailed Jun. 13, 2012, directed to U.S. Appl. No. 12/791,470; 8 pages.

Follows, T. et al., Office Action mailed Jun. 4, 2012, directed to U.S. Appl. No. 12/791,574; 13 pages.

Follows et al., U.S. Office Action mailed Sep. 21, 2012, directed to U.S. Appl. No. 12/791,574; 13 pages.

Follows et al., U.S. Office Action mailed Nov. 6, 2012, directed to U.S. Appl. No. 12/791,470; 10 pages.

Follows et al., U.S. Office Action mailed Mar. 6, 2013, directed to U.S. Appl. No. 12/791,574; 14 pages.

Follows et al., U.S. Office Action mailed Jun. 27, 2013, directed to U.S. Appl. No. 12/791,574; 11 pages.

Follows et al., U.S. Office Action mailed Jun. 5, 2013, directed to U.S. Appl. No. 13/759,771; 11 pages.

Gordon Brush Mfg Co. Inc. (2004) "ESD & Cleanroom Brushes," located at <http://www.gordonbrush.com/documents/ESDCAT-06%20Low%20Res.pdt> visited on Jul. 11, 2013. (12 pages).

Follows et al., U.S. Office Action mailed Nov. 6, 2013, directed to U.S. Appl. No. 13/759,771; 12 pages.

Follows et al., U.S. Office Action mailed Nov. 21, 2013, directed to U.S. Appl. No. 12/791,574; 12 pages.

* cited by examiner

CLEANER HEAD

REFERENCE TO RELATED APPLICATIONS

This application claims the priority of United Kingdom Application No. 0909896.3, filed Jun. 9, 2009, the entire contents of which are incorporated herein by reference.

FIELD OF THE INVENTION

The present invention relates to agitating apparatus for a surface treating appliance, and to a cleaner head for a surface treating appliance. In its preferred embodiment, the present invention relates to a cleaner head for a vacuum cleaning appliance.

BACKGROUND OF THE INVENTION

A vacuum cleaner typically comprises a main body containing dirt and dust separating apparatus, a cleaner head connected to the main body and having a suction opening, and a motor-driven fan unit for drawing dirt-bearing air through the suction opening. The dirt-bearing air is conveyed to the separating apparatus so that dirt and dust can be separated from the air before the air is expelled to the atmosphere.

The suction opening is directed downwardly to face the floor surface to be cleaned. The separating apparatus can take the form of a filter, a filter bag or, as is known, a cyclonic arrangement. The present invention is not concerned with the nature of the separating apparatus and is therefore applicable to vacuum cleaners utilizing any of the above arrangements or another suitable separating apparatus.

A driven agitator, usually in the form of a brush bar, is supported in the cleaner head so as to protrude to a small extent from the suction opening. The brush bar is activated mainly when the vacuum cleaner is used to clean carpeted surfaces. The brush bar comprises an elongate cylindrical core bearing bristles which extend radially outward from the core. The brush bar may be driven by an air turbine or by an electric motor powered by a power supply derived from the main body of the cleaner. The brush bar may be driven by the motor via a drive belt, or may be driven directly by the motor, so as to rotate within the suction opening. Rotation of the brush bar causes the bristles to sweep along the surface of the carpet to be cleaned to loosen dirt and dust, and pick up debris. The suction of air causes air to flow underneath the sole plate and around the brush bar to help lift the dirt and dust from the surface of the carpet and then carry it from the suction opening through the cleaner head towards the separating apparatus.

SUMMARY OF THE INVENTION

The bristles of the brush bar are usually formed from nylon. While the use of nylon bristles provides an acceptable cleaning performance on carpeted floor surfaces, we have found that the use of nylon bristles generates static electricity when the floor tool is used on some hard floor surfaces, such as laminate, wood and vinyl surfaces, which attracts fine dust and powders, such as talcum powder, on to the floor surface. This can impair the cleaning performance on the cleaner head on such floor surfaces, as the sweeping action of the nylon bristles is insufficient to overcome the force attracting the fine dust to the floor surface.

In a first aspect, the present invention provides agitating apparatus for a surface treating appliance, comprising first surface agitating means and second surface agitating means extending outwardly from the apparatus beyond the first surface agitating means and having a lower surface resistivity than the first surface agitating means.

The agitating apparatus thus comprises two surface agitating means. The relatively short, first agitating means may be configured to agitate dirt and dust from a carpeted floor surface, whereas the relatively long, second agitating means may be configured to sweep dirt and dust from a hard floor surface. Forming this second agitating means from material having a lower surface resistivity than that from which the first agitating means is formed can enable static electricity residing on a floor surface to be cleaned to be discharged upon contact between the second agitating means and the floor surface. This enables fine dust and powder which would otherwise be attracted to the floor surface to be dislodged from the floor surface by the second agitating means.

The surface resistivity of the second agitating means is preferably in the range from $1\times10^{-5}$ to $1\times10^{12}$ Ω/sq (ohms per square). Values of surface resistivity discussed herein are as measured using the test method ASTM D257. The selection of material having a surface resistivity in this range can ensure that any static electricity on the floor surface is effectively discharged by the second agitating means. Therefore, in a second aspect the present invention provides agitating apparatus for a surface treating appliance, comprising first surface agitating means and second surface agitating means extending outwardly from the apparatus beyond the first surface agitating means and having a surface resistivity in the range from $1\times10^{-5}$ to $1\times10^{12}$ Ω/sq.

The second agitating means is preferably formed from one of metallic, carbon fiber, carbon composite or other composite material. For example, material comprising carbon particles and carbon fibers generally has a surface resistivity in the range from $1\times10^{3}$ to $1\times10^{6}$ Ω/sq, whereas metallic material generally has a much lower surface resistivity, generally lower than 1 Ω/sq. Other static dissipative materials generally have a surface resistivity in the range from $1\times10^{5}$ to $1\times10^{12}$ Ω/sq.

The first agitating means may be formed from electrically insulating, plastics material, such as nylon, and so may have a surface resistivity in the range from $1\times10^{12}$ to $1\times10^{16}$ Ω/sq. Alternatively, the first agitating means may be formed from a similar material as the second agitating means, and so may have a surface resistivity within the aforementioned range for the second agitating means, in order to discharge any static electricity residing on a carpeted floor surface.

The first agitating means is preferably spaced from the second agitating means. However, the first agitating means may be located within, or otherwise in contact with, the second agitating means. For example, each of the agitating means may comprises a plurality of bristles or filaments, with the bristles or filaments of the first agitating means being located adjacent, or amongst, bristles or filaments of the second agitating means.

Preferably, the second agitating means protrudes outwardly beyond the first agitating means by a distance in the range from 0.5 to 5 mm, more preferably by a distance in the range from 1 to 3 mm.

The first agitating means may be moveable relative to the second agitating means. For example the first and second agitating means may be mounted on or otherwise comprise respective bodies which are moveable relative to each other. By way of example, the first agitating means may be mounted on a first body which is rotated about a first axis or translated in a first direction, and the second agitating means may be mounted on a second body which is rotated about a second axis or translated in a second direction. In a preferred embodiment, however, the first agitating means and the second agitating means are rotatable about a common axis, and are preferably mounted on a common rotatable body. This body may be in the form of a disc or plate, with the first and second agitating means being mounted on the same side of that disc or plate so that the second agitating means protrudes outwardly from that side beyond the first agitating means. Preferably though, the second agitating means protrudes radially outwardly from the body beyond the first agitating means. The agitating means may be arranged in any desired pattern, or randomly, on the body. In a preferred embodiment, each of the agitating means is arranged in at least one helical formation along the body.

One, or both, of the agitating means may comprise a plurality of bristles, filaments or other agitating members. For example, one or both agitating means may comprise at least one strip of material mounted on the body. Where the first agitating means comprises a plurality of bristles, these bristles are preferably arranged in one or more rows of clusters or tufts of bristles connected to the body. The second agitating means is preferably arranged in a plurality of rows along the body. However, where the second agitating means comprises a plurality of bristles or filaments, each row of bristles or filaments is preferably continuous so that no patterns of dirt or dust are formed on the floor surface as each row is swept thereover. Similarly, where the second agitating means comprises at least one strip of material, each row is preferably formed from a single strip of material, or from a plurality of adjoining strips. For example, bristles of the second agitating means may be formed from carbon fibers or conductive acrylic fibers such as Thunderon® fibers.

At least two rows of the second agitating means may be in electrical contact. In a preferred embodiment, adjacent rows of the second agitating means are in electrical contact. For example, at least one agitating member of one row may also form at least one agitating member of another row. Such agitating members may pass through one or more apertures formed in the rotatable body of the agitating apparatus, or may be otherwise connected to the body so that two rows each comprise a respective end of an agitating member. In a preferred embodiment, a row of bristles or filaments is sandwiched between the rotatable body and a connecting member connected to the body so that the ends of the bristles or filaments protrude from the body to define respective rows of the second agitating means. A strip of material may be similarly connected to the rotatable body so that portions of the strip form respective rows of the second agitating means. This can simplify manufacture of the agitating apparatus, and reduce costs.

The first agitating means is preferably relatively stiff in comparison to the second agitating means. For example, bristles or filaments of the first agitating means may have a greater diameter than bristles or filaments of the second agitating means. Bristles of the first agitating means preferably have a diameter in the range from 100 to 200 μm. Bristles of the second agitating means preferably have a diameter in the range from 5 to 20 μm.

The agitating apparatus is preferably in the form of a rotatable brush bar. The present invention thus also provides a cleaner head for a surface treating appliance comprising a housing and a rotatable brush bar located within the housing, the brush bar comprises a first plurality of bristles and a second plurality of bristles which protrude radially outwardly beyond the first plurality of bristles. The second plurality of bristles preferably has a surface resistivity in the range from $1\times10^{-5}$ to $1\times10^{12}$ Ω/sq so that static electricity residing on a floor surface to be cleaned is discharged upon contact with the conductive bristles. The second plurality of bristles may comprise carbon fiber bristles, In a third aspect, the present invention provides a cleaner head for a surface treating appliance, the cleaner head comprising a housing and apparatus as aforementioned. The cleaner head preferably comprises a plurality of support members, preferably in the form of rolling elements such as wheels or rollers, for supporting the cleaner head on a surface to be cleaned. Preferably, the first agitating means does not protrude beneath a plane extending between the lowermost extremities of the support members so that when the cleaner head is located on a hard floor surface the first agitating means does not come into contact with that floor surface. This can inhibit scratching or marking of the floor surface by this agitating means, especially when the first agitating means is formed from relatively stiff material. When the cleaner head is located on a carpeted surface, the support members may sink into the fibers of the carpet to bring the first agitating means into contact with the carpet.

The cleaner head preferably comprises a sole plate having a suction opening through which dirt-bearing air enters the cleaner head, and through which the agitating means protrude as the agitating apparatus is rotated or otherwise moved during use of the cleaner head, and the support members are preferably rotatably mounted on the sole plate.

In a fourth aspect, the present invention provides a surface treating appliance comprising a cleaner head or agitating apparatus as aforementioned.

The term "surface treating appliance" is intended to have a broad meaning, and includes a wide range of machines having a main body and a head for travailing over a surface to clean or treat the surface in some manner. It includes, inter alia, machines which simply agitate the surface, such as carpet sweepers, machines which only apply suction to the surface, such as vacuum cleaners (dry, wet and wet/dry), so as to draw material from the surface, and machines which apply material to the surface, such as polishing/waxing machines, pressure washing machines and shampooing machines.

Features described above in connection with the first aspect of the invention are equally applicable to any of the second to fourth aspects of the invention, and vice versa.

BRIEF DESCRIPTION OF THE DRAWINGS

An embodiment of the present invention will now be described, by way of example only, with reference to the accompanying drawings, in which.

DETAILED DESCRIPTION OF THE INVENTION

Figure 1:
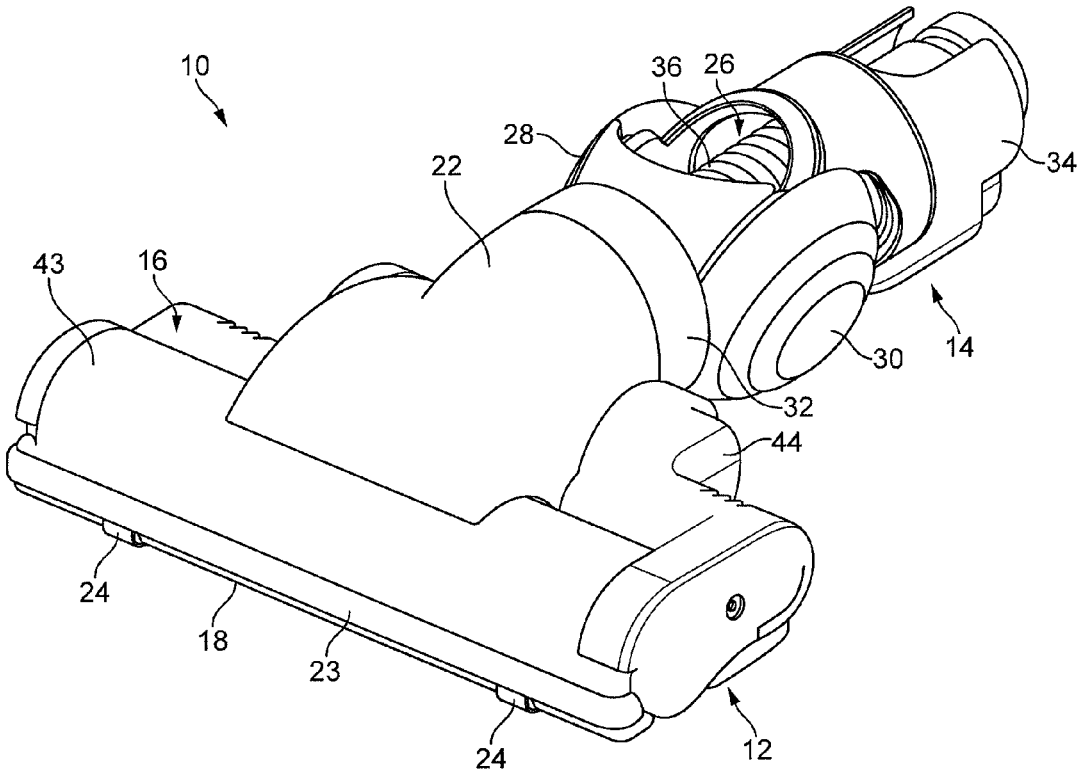
FIG. 1 is a front perspective view, from above, of a floor tool.
Figure 2:
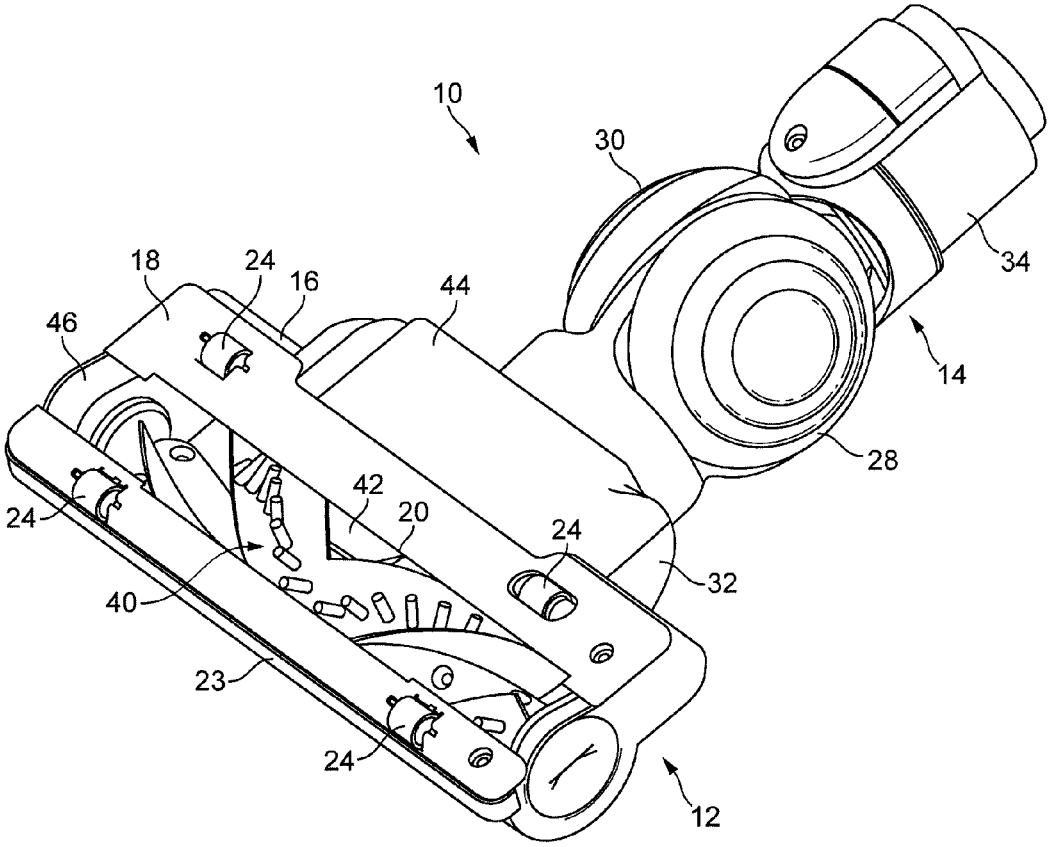
FIG. 2 is a front perspective view, from below, of the floor tool of FIG. 1.
Figure 3:
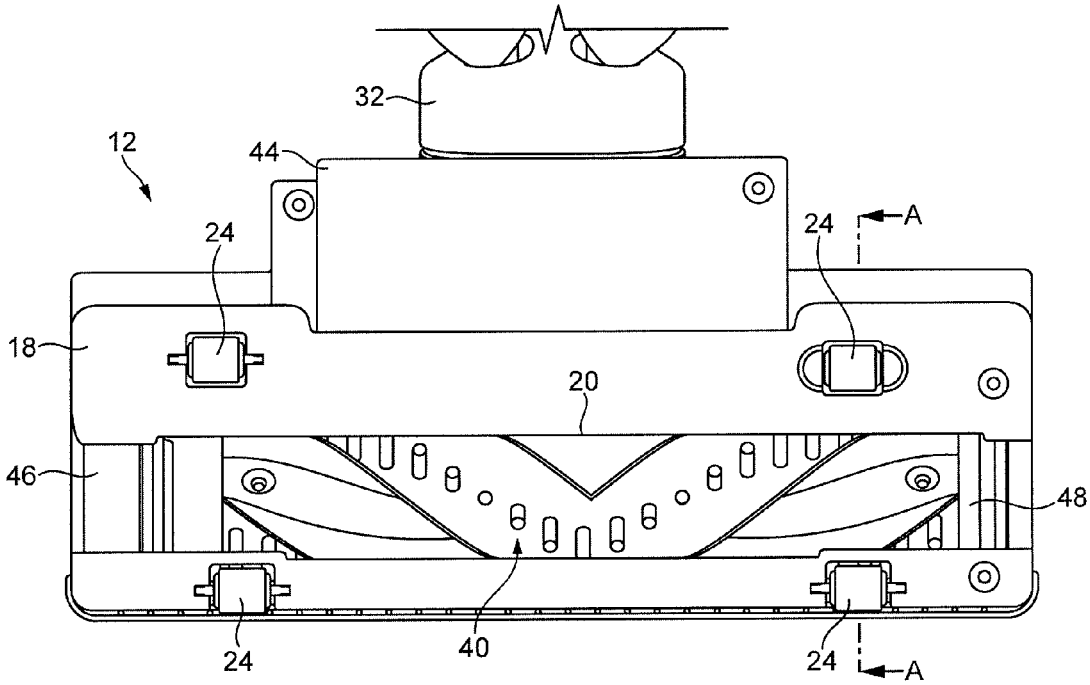
FIG. 3 is a bottom view of the floor tool of FIG. 1.

With reference first to FIGS. 1 to 3, a floor tool 10 comprises a cleaner head 12 rotatably attached to a coupling 14.

Figure 7:
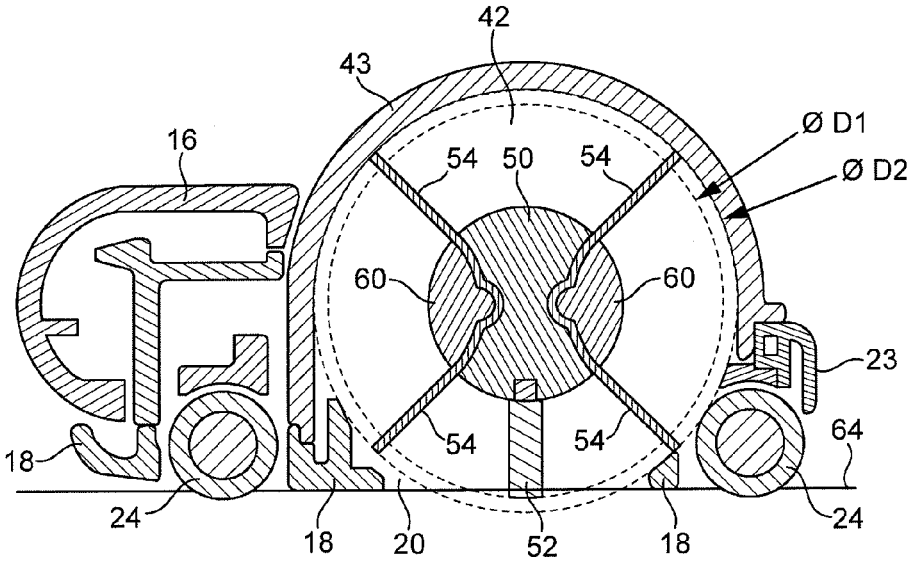
FIG. 7 is a section taken along line A-A illustrated in FIG. 3 when the floor tool is located on a carpeted floor surface.
Figure 8:
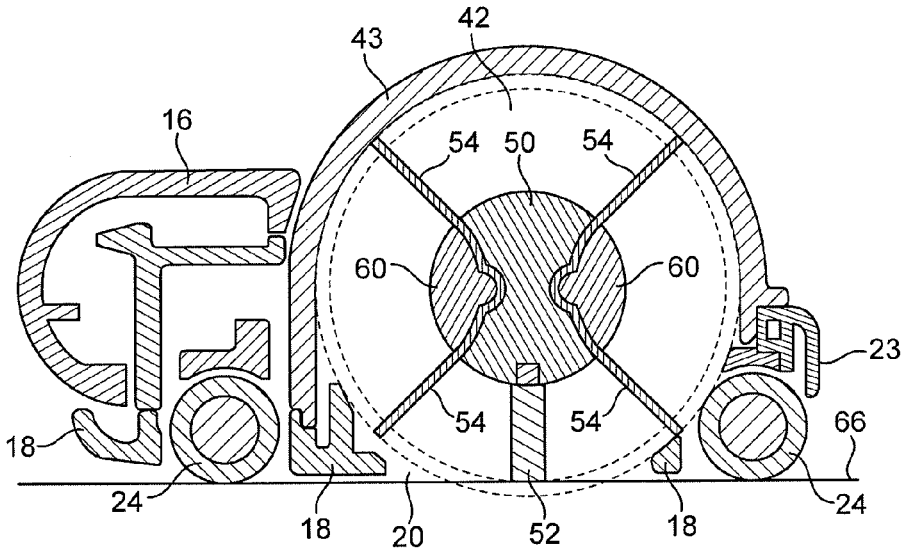
FIG. 8 is a section taken along line A-A illustrated in FIG. 3 when the floor tool is located on a hard floor surface.

The free end of the coupling 14 is attachable to a wand, hose or other such duct of a cleaning appliance (not shown). The cleaner head 12 comprises a housing 16 and a lower plate, or sole plate 18, comprising a suction opening 20 through which a dirt-bearing fluid flow enters the cleaner head 12. The housing 16 defines a suction passage extending from the suction opening 20 to an outlet duct 22 located at the rear of the housing 16. The housing 16 preferably comprises a front bumper 23. The sole plate 18 comprises a plurality of support members 24 in the form of rolling elements mounted within recessed portions of the sole plate 18 for supporting the cleaner head 12 on a floor surface. With reference to FIGS. 7 and 8, the support members 24 are preferably arranged to support the sole plate 18 above the floor surface when the cleaner head 12 is located on a hard floor surface 66, and, when the cleaner head 12 is located on a carpeted floor surface 64, to sink into the pile of the carpet to enable the bottom surface of the sole plate 18 to engage the fibers of the carpet. The sole plate 18 is preferably pivotable relative to the housing 16 to allow the sole plate 18 to ride smoothly over the carpeted floor surface 64 during cleaning.

The coupling 14 comprises a conduit 26 supported by a pair of wheels 28, 30. The conduit 26 comprises a forward portion 32 connected to the outlet duct 22, a rearward portion 34 pivotably connected to the forward portion 32 and connectable to a wand, hose or other such duct of a cleaning appliance which comprises dirt and dust separating apparatus and a motor-driven fan unit for drawing dirt-bearing air through the suction opening 20 from the floor surface. A flexible hose 36 is held within and extends between the forward and the rearward portions 32, 34 of the conduit 26.

The cleaner head 12 comprises agitating apparatus for agitating dirt and dust located on the floor surface. In this example the agitating apparatus comprises a rotatable brush bar 40 which is mounted within a brush bar chamber 42 of the housing 16. The brush bar chamber 42 is partially defined by a generally semi-cylindrical portion 43 of the housing 16, which is preferably formed from transparent material. The brush bar 40 is driven by a motor (not shown) located in a motor housing 44 of the housing 16. The motor is electrically connected to a terminal located in the rearward portion 34 of the conduit 26 for connection with a conformingly profiled terminal located in a duct of the cleaning appliance to enable electrical power to be supplied to the motor.

The brush bar 40 is connected to the motor by a drive mechanism located, at least in part, within a drive mechanism housing 46 so that the drive mechanism is isolated from the air passing through the suction passage. One end of the brush bar 40 is connected to the drive mechanism to enable the brush bar 40 to be driven by the motor, whereas the other end of the brush bar 40 is rotatably supported by an end cap 48 mounted on a side wall of the brush bar chamber 42.

Figure 4:
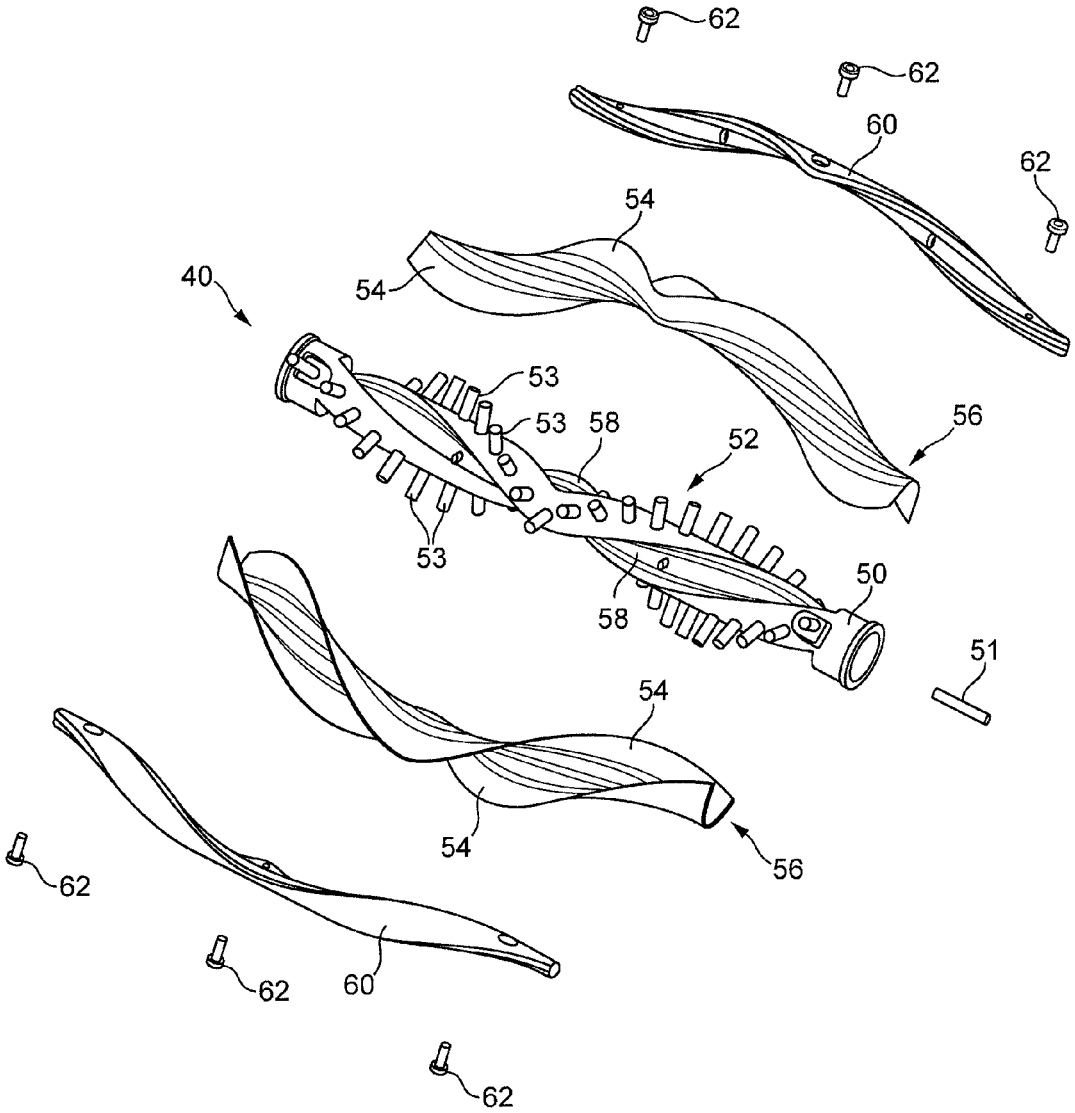
FIG. 4 is an exploded view of the brush bar of the floor tool of FIG. 1.
Figure 5:
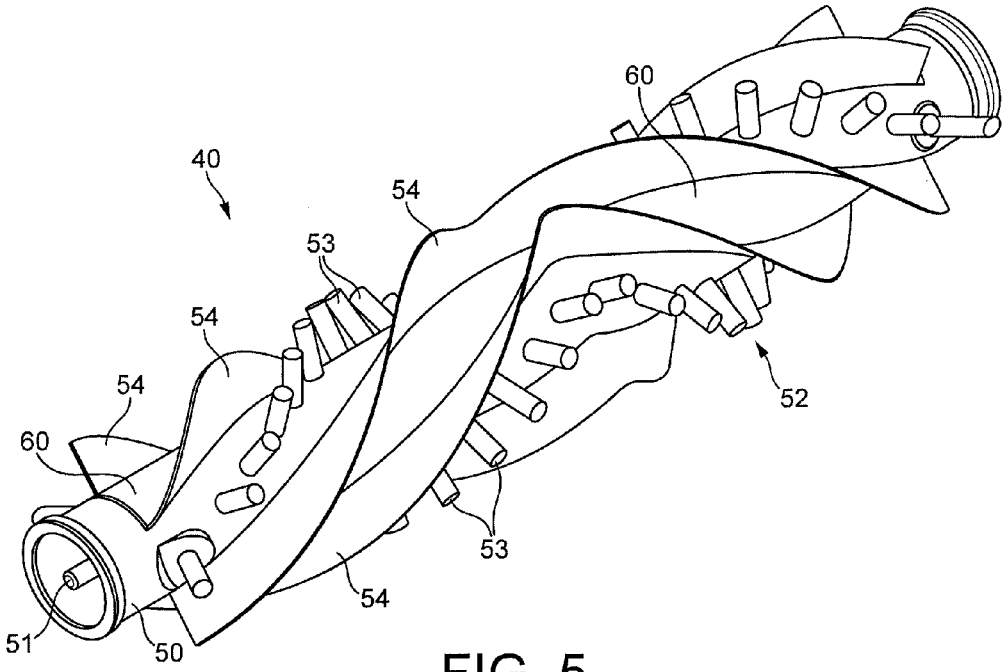
FIG. 5 is a perspective view of the brush bar of FIG. 4.
Figure 6:
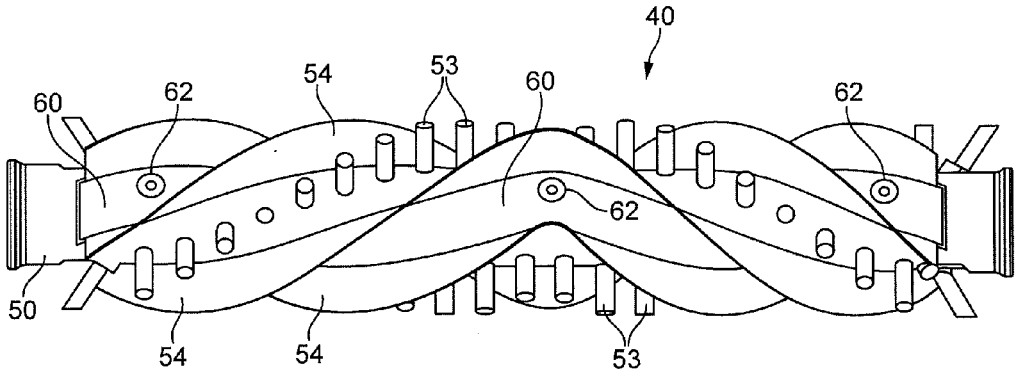
FIG. 6 is a top view of the brush bar of FIG. 4.

The brush bar 40 is illustrated in more detail in FIGS. 4 to 6. The brush bar 40 comprises an elongate body 50 bearing two different types of agitating means for agitating dirt and dust from the floor surface as the brush bar 40 is rotated by the motor. Each of the different types of agitating means protrudes from the suction opening 20 in the sole plate 18 as the brush bar 40 is rotated by the motor. A spindle 51 is mounted on one end of the body 50, with the spindle 51 being in turn connected to the end cap 48.

A first agitating means mounted on the body 50 of the brush bar 40 comprises relatively short, preferably relatively stiff, bristles 52. These bristles 52 are preferably formed from nylon. In this embodiment the relatively short bristles 52 are arranged in two angularly spaced, helical rows extending along the body 50. Within each row, the relatively short bristles 52 are arranged in a series of clusters or tufts 53 regularly spaced along the row. Each tuft 53 preferably comprises around 100 to 150 bristles, with each tuft 53 having a diameter in the range from 2 to 4 mm. The diameter of each bristle 52 is preferably in the range from 100 to 200 μm. The length of the relatively short bristles 52 is chosen so that, when the floor tool 50 is assembled, the tips of these bristles 52 do not protrude beneath a plane extending between the lowermost extremities of the support members 24 during rotation of the brush bar 40.

A second agitating means mounted on the body 50 of the brush bar 40 comprises relatively long, preferably relatively soft, bristles 54. As illustrated in FIG. 7, the relatively long bristles 54 protrude radially outwardly from the body 50 beyond the relatively short bristles 52. During rotation of the body 50, the relatively short bristles 52 sweep a cylindrical volume having a diameter D1, whereas the relatively long bristles 54 sweep a cylindrical volume having a diameter D2 which is greater than D1. The difference between D1 and D2 is preferably in the range from 1 to 10 mm, more preferably in the range from 2 to 6 mm. In contrast to the relatively short bristles 52, the length of the relatively long bristles 54 is chosen so that the relatively long bristles 54 protrude beyond the plane extending between the lowermost extremities of the support members 24 during rotation of the brush bar 40.

The relatively long bristles 54 are formed from material having a lower surface resistivity than the material from which the relatively short bristles 52 are formed. The surface resistivity of the relatively long bristles 54 is preferably in the range from $1\times10^{-5}$ to $1\times10^{12}$ Ω/sq. In comparison, the surface resistivity of the relatively short bristles 52 is preferably higher than $1\times10^{12}$ Ω/sq. The relatively long bristles 54 may be formed from electrically conductive material. The bristles may be formed from metallic, graphite, conductive acrylic or other composite material, but in this example the relatively long bristles 54 comprise carbon fiber bristles. The diameter of each bristle 54 is preferably in the range from 5 to 20 μm.

The body 50 comprises a plurality of angularly spaced, continuous rows of the relatively long bristles 54, which preferably also extend helically along the body 50. In this embodiment the body 50 comprises four continuous rows of the relatively long bristles 54, with each row being angularly spaced from a row of tufts 53 formed from the relatively short bristles 52. Each row of the relatively long bristles 54 preferably contains in the range from 20 to 100 bristles per mm length, and has a thickness in the range from 0.25 to 2 mm.

With particular reference to FIG. 4, in this embodiment adjacent rows of the relatively long bristles 54 are formed from a single strip 56 of bristles. Each strip 56 is preferably formed by attaching an elongate, generally rectangular flexible carrier member to a row of bristles so that each row of bristles 54 protrudes outwardly from a respective long side edge of the carrier member. The carrier member may be attached to the row of bristles by stitching or by using an adhesive. Each strip 56 is then located within a respective helical groove 58 formed in the body 50 so that the ends of the bristles protrude outwardly from the body 50. The strips 56 are connected to the body 50 by helical connectors 60 which are mounted on the strips 56 and connected to the body 50 using screws 62 into apertures formed in the connectors 60. The screws 62 may be pushed through the carrier member, or inserted through apertures formed in the carrier member. An adhesive tape may be applied to at least one side of each carrier member to allow the strips 56 to be aligned within the grooves 58 so that the ends of the bristles protrude from the body 50 by a regular amount along the length of the body 50.

With reference to FIG. 7, when the cleaner head 12 is located on a carpeted floor surface 64 the support members 24 sink into the pile of the carpet so that the bottom surface of the sole plate 18 engages the fibers of the carpet. As both the relatively short bristles 52 and the relatively long bristles 54 protrude from the suction opening 20 as the brush bar 40 rotates, both the different types of bristles are able to agitate dirt and dust from the floor surface. When an air flow is generated through the suction passage of the cleaner head 12, this dirt and dust becomes entrained within the air flow and is conveyed through the floor tool 10 to the cleaning appliance.

When the cleaner head 12 is moved from the carpeted floor surface 64 on to a hard floor surface 66, as illustrated in FIG. 8, the sole plate 18 becomes spaced from the hard floor surface 66. As the tips of the relatively short bristles 52 do not protrude beneath the plane extending between the lowermost extremities of the support members 24, these bristles do not come into contact with the hard floor surface 66, thereby preventing scratching or other marking of the hard floor surface 66 by these bristles. However, as the relatively long bristles 54 protrude beyond this plane, these bristles engage, and are swept across, the hard floor surface 66 with rotation of the brush bar 40. Due to the relatively low surface resistivity of the relatively long bristles 54, any static electricity residing on the hard floor surface 66 is discharged upon contact with the relatively long bristles 54, thereby enabling fine dust and powder which would otherwise be attracted to the hard floor surface 66 to be dislodged from the floor surface by these bristles and entrained within the air flow.

The invention is not limited to the detailed description given above. Variations will be apparent to the person skilled in the art.

For example, in the embodiment described above, the cleaner head 12 includes a brush bar 40 that is driven by a motor. However, the cleaner head 12 may include alternative means for agitating or otherwise working a surface to be cleaned. By way of example, the brush bar 40 may be driven by an air turbine rather than a motor.

The relatively short bristles 52 may be formed from similar material as the relatively long bristles 54 in order to discharge any static material residing on a carpeted floor surface, and so may also have a surface resistivity in the range from $1\times10^{-5}$ to $1\times10^{12}$ Ω/sq.

Figure 9:
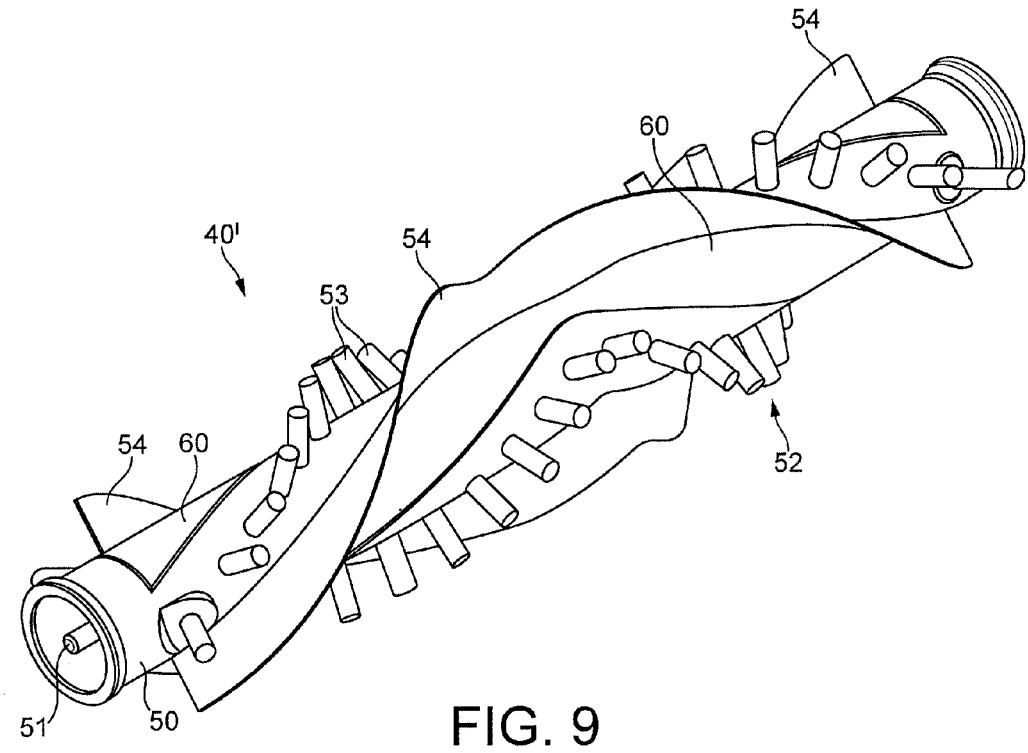
FIG. 9 is a perspective view of a modified version of the brush bar of FIG. 4.

Each strip 56 may be modified so that the bristles protrude from only one of the relatively long side edges of the carrier member. Thus, each strip 56 may be in the form of a brush, with bristles extending outwardly from only one side of the brush. A modified version of the brush bar 40', in which each strip 56 has been modified as discussed above, is illustrated in FIG. 9. This modification of the strips 56 results in the bristles 54 protruding outwardly from one side only of each connecting member 60. Consequently, this brush bar 40' contains only two continuous rows of relatively long bristles 54, with the rows of tufts 53 and the rows of relatively long bristles 54 being alternately arranged about the body 50 of the brush bar 40'. As with the brush bar 40, the relatively long bristles 54 protrude radially outwardly from the body 50 beyond the relatively short bristles 52.

The different types of bristles 52, 54 need not be spaced apart. The brush bar 40 may comprise a plurality of rows, clumps or tufts of bristles, with each row, clump or tuft comprising both types of bristles. For example, relatively short bristles 52 may be dispersed within each row of relatively long bristles 54. Alternatively, relatively long bristles 54 may be dispersed within each tuft 53 of relatively short bristles 52.

The agitating means may take forms other than bristles, such as flexible or rigid strips of material mounted on the body 50, or filaments sewn into a backing material connected to the body 50.

In the event that the floor tool 10 is not to be used on a carpeted surface, the relatively short bristles 52 may be dispensed with so that the brush bar 40 comprises only electrically conductive agitating members. Consequently, the brush bar 40 may comprise solely the continuous rows of surface agitating members defined by the relatively long bristles 54 illustrated in FIGS. 2 to 8. Alternatively, the brush bar 40 may comprise a different arrangement of surface agitating members for discharging static electricity residing on a floor surface.

Figure 10:
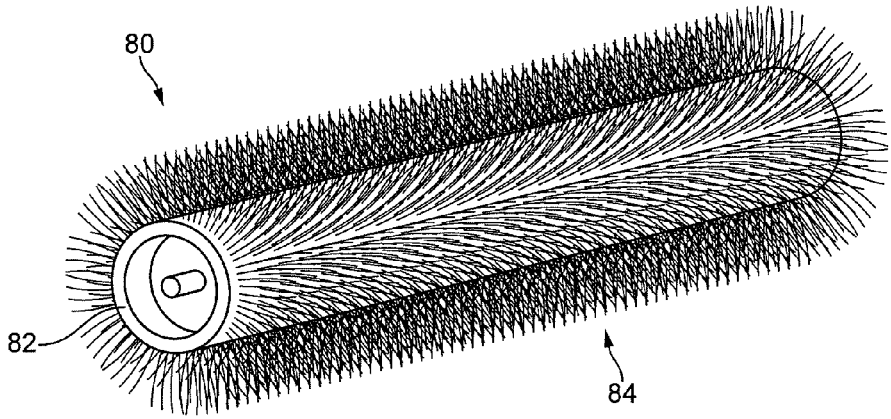
FIG. 10 is a perspective view of an alternative brush bar for use with the floor tool of FIG. 1.

For example, with reference to FIG. 10 an alternative brush bar 80 for use in the floor tool 10 comprises a rotatable body 82 having an outer surface comprising an electrically conductive pile 84. In this example, the pile 84 is similar to the raised or fluffy surface of a carpet, rug or cloth, and comprises filaments woven on to a fabric carrier member 86 attached to the body 82, for example using an adhesive. The length of the filaments of the pile 84 is preferably in the range from 4 to 15 mm, and the filaments have a diameter which is preferably in the range from 5 to 20 μm.

These filaments are preferably formed from carbon fibers, but alternatively they may be formed from metallic material, conductive acrylic material or other composite material. Consequently, the surface resistivity of the filaments of the pile 84 is preferably in the range from $1\times10^{-5}$ to $1\times10^{12}$ Ω/sq. The fabric carrier member 86 may be in the form of a strip wound on to the body 82 so that the pile 84 is substantially continuous, substantially covering the outer surface of the body 82. Alternatively, the carrier member 86 may be in the form of a cylindrical sleeve into which the body 82 is inserted.

If so desired, clumps of relatively stiff bristles may be dispersed within the pile 84. Alternatively, a strip of the pile 84 may be wound around one or more helical rows of relatively stiff bristles previously attached to the body 82. These bristles may be similar to the relatively short bristles 52 of the brush bar 40, and so may be arranged so as to not protrude radially outwardly beyond the filaments of the pile 84.

The invention claimed is:

1. A cleaner head for a surface treating appliance comprising a sole plate comprising a suction opening, an agitating apparatus comprising first surface agitating members configured to agitate dirt or dust from a carpeted floor surface and second surface agitating members configured to sweep dust from a hard floor surface, the second surface agitating members extending outwardly from the apparatus beyond the first surface agitating members and having a lower surface resistivity than the first surface agitating members, and a plurality of support members rotatably mounted on the sole plate for supporting the cleaner head on a surface to be cleaned, wherein the first agitating members do not protrude beneath a plane extending between the lowermost extremities of the support members and wherein the second surface agitating members protrude beneath a plane extending between the lowermost extremities of the support members.

2. The cleaner head of claim 1, wherein the second agitating members are formed from an electrically conductive material.

3. The cleaner head of claim 1, wherein the first agitating members are formed from plastics material.

4. The cleaner head of claim 1, wherein the second agitating members are formed from one of metallic, carbon fiber, conductive acrylic and composite material.

5. The cleaner head of claim 1, wherein the first agitating members and the second agitating members are rotatable about a common axis.

6. The cleaner head of claim 1, wherein the first agitating members and the second agitating members are mounted on a rotatable body.

7. The cleaner head of claim 6, wherein the second agitating members extend radially outwardly from the body beyond the first surface agitating members.

8. The cleaner head of claim 7, wherein each of the first agitating members and the second agitating members are arranged in at least one helical formation along the body.

9. The cleaner head of claim 6, wherein the second agitating members are arranged in a plurality of rows along the body.

10. The cleaner head of claim 1, wherein the first agitating members comprise one of a plurality of bristles, a plurality of filaments, and at least one strip of material.

11. The cleaner head of claim 1, wherein the second agitating members comprise one of a plurality of bristles, a plurality of filaments, and at least one strip of material.

12. The cleaner head of claim 1, wherein the second agitating members comprise one of carbon fibers and conductive acrylic fibers.

13. The cleaner head of claim 1, wherein the first agitating members have a higher stiffness than the second agitating members.

14. The cleaner head of claim 1, in the form of a rotatable brush bar.

15. The cleaner head of claim 1, wherein the first surface agitating members are spaced from the second surface agitating members so that the first surface agitating members are neither supported by nor support the second surface agitating members.

16. A cleaner head for a surface treating appliance comprising a sole plate comprising a suction opening, an agitating apparatus comprising first surface agitating members configured to agitate dirt or dust from a carpeted floor surface and second surface agitating members configured to sweep dust from a hard floor surface, the second surface agitating members extending outwardly from the apparatus beyond the first surface agitating members and being formed from an electrically conductive material and a plurality of support members rotatably mounted on the sole plate for supporting the cleaner head on a surface to be cleaned, wherein the first agitating members do not protrude beneath a plane extending between the lowermost extremities of the support members and wherein the second surface agitating members protrude beneath a plane extending between the lowermost extremities of the support members.

17. The cleaner head of claim 16, wherein the first agitating members are formed from one of metallic, carbon fiber, and composite material.

18. The cleaner head of claim 16, wherein the first agitating members are formed from an electrically conductive material.

19. The cleaner head of claim 16, wherein the first agitating members are formed from plastics material.

20. The cleaner head of claim 16, wherein the second agitating members are formed from one of metallic, carbon fiber, and composite material.

21. The cleaner head of claim 16, wherein the first agitating members and the second agitating members are rotatable about a common axis.

22. The cleaner head of claim 16, wherein the first agitating members and the second agitating members are mounted on a rotatable body.

23. The cleaner head of claim 22, wherein the second agitating members extend radially outwardly from the body beyond the first surface agitating members.

24. The cleaner head of claim 23, wherein each of the first agitating members and the second agitating members is arranged in at least one helical formation along the body.

25. The cleaner head of claim 22, wherein the second agitating members are arranged in a plurality of rows along the body.

26. The cleaner head of claim 16, wherein the first agitating members comprise one of a plurality of bristles, a plurality of filaments, and at least one strip of material.

27. The cleaner head of claim 16, wherein the second agitating members comprise one of a plurality of bristles, a plurality of filaments, and at least one strip of material.

28. The cleaner head of claim 16, wherein the second agitating members comprise one of carbon fibers and conductive acrylic fibers.

29. The cleaner head of claim 16, wherein the first agitating members have a higher stiffness than the second agitating members.

30. The cleaner head of claim 16, in the form of a rotatable brush bar.

31. A cleaner head for a surface treating appliance comprising a sole plate comprising a suction opening, an agitating apparatus comprising first surface agitating members configured to agitate dirt or dust from a carpeted floor surface and second surface agitating members configured to sweep dust from a hard floor surface, the second surface agitating members extending outwardly from the apparatus beyond the first surface agitating members and having a lower surface resistivity than the first surface agitating members and the first agitating members and the second agitating members being substantially equally angularly spaced around the agitating apparatus, and a plurality of support members rotatably mounted on the sole plate for supporting the cleaner head on a surface to be cleaned, wherein the first agitating members do not protrude beneath a plane extending between the lowermost extremities of the support members and wherein the second surface agitating members protrude beneath a plane extending between the lowermost extremities of the support members.

32. The cleaner head of claim 16, wherein the first surface agitating members are spaced from the second surface agitating members so that the first surface agitating members are neither supported by nor support the second surface agitating members.

* * * * *